US010989049B2

(12) United States Patent
Yuratich et al.

(10) Patent No.: US 10,989,049 B2
(45) Date of Patent: Apr. 27, 2021

(54) APPARATUS AND METHODS FOR HIGH QUALITY ANALYSIS OF RESERVOIR FLUIDS

(71) Applicants: PIETRO FIORENTINI (USA), INC., Wheeling, WV (US); PIETRO FIORENTINI SPA, Arcugnano (IT)

(72) Inventors: Michael Yuratich, Hamble (GB); Philip Powell, New Alresford (GB)

( * ) Notice: Subject to any disclaimer, the term of this patent is extended or adjusted under 35 U.S.C. 154(b) by 0 days.

(21) Appl. No.: 16/617,014

(22) PCT Filed: Jan. 16, 2019

(86) PCT No.: PCT/US2019/013727

§ 371 (c)(1),
(2) Date: Oct. 27, 2020

(87) PCT Pub. No.: WO2019/143642

PCT Pub. Date: Jul. 25, 2019

(65) Prior Publication Data

US 2021/0087930 A1 Mar. 25, 2021

Related U.S. Application Data

(60) Provisional application No. 62/619,742, filed on Jan. 20, 2018.

(51) Int. Cl.

| | |
|---|---|
| ***E21B 23/04*** | (2006.01) |
| ***E21B 43/00*** | (2006.01) |
| ***E21B 49/00*** | (2006.01) |
| ***E21B 49/02*** | (2006.01) |
| ***E21B 49/04*** | (2006.01) |
| ***E21B 49/06*** | (2006.01) |
| ***E21B 49/08*** | (2006.01) |
| ***E21B 49/10*** | (2006.01) |
| ***G01N 1/10*** | (2006.01) |

(52) U.S. Cl.
CPC ..... *E21B 49/10* (2013.01); *E21B 23/04* (2013.01)

(58) Field of Classification Search
CPC .... E21B 49/081; E21B 49/082; E21B 49/083; E21B 49/0813; E21B 49/0815; E21B 49/08; E21B 49/008; E21B 49/06; E21B 49/00; G01N 1/2035
See application file for complete search history.

(56) References Cited

U.S. PATENT DOCUMENTS 2,965,176 A 12/1960 Brieger
3,261,402 A 7/1966 Whitten
(Continued)

FOREIGN PATENT DOCUMENTS

WO WO-2019143642 A1 * 7/2019 ..... E21B 49/10

*Primary Examiner* — Daniel P Stephenson
(74) *Attorney, Agent, or Firm* — Matthew J Patterson

(57) ABSTRACT

Methods and systems for collecting high quality reservoir samples are disclosed. The systems and methods of the present invention are especially important in collecting samples of reservoir fluids in a manner that most closely resembles production fluids. The systems include an upper shoe and a lower shoe that are asymmetrically spaced along the axial length of probe module with respect to a sampling probe to allow for the placement of a component compartment proximate the probe. Sensors or modules for testing or analyzing reservoir fluids are positioned within the compartment.

17 Claims, 3 Drawing Sheets

(56) References Cited

U.S. PATENT DOCUMENTS

| | | | | |
|---|---|---|---|---|
| 4,339,948 | A | 7/1982 | Hallmark | |
| 4,593,560 | A | 6/1986 | Purfurst | |
| 4,745,802 | A | 5/1988 | Purfurst | |
| 4,879,900 | A | 11/1989 | Gilbert | |
| 4,884,439 | A | 12/1989 | Baird | |
| 4,941,350 | A | 7/1990 | Schneider | |
| 5,207,104 | A | 5/1993 | Enderlin | |
| 5,230,244 | A | 7/1993 | Gilbert | |
| 7,080,552 | B2 | 7/2006 | Jones et al. | |
| 9,234,835 | B2 | 1/2016 | Pelletier et al. | |
| 9,303,510 | B2 * | 4/2016 | Dumont | E21B 49/082 |
| 9,581,020 | B2 * | 2/2017 | Edwards | G01V 8/00 |
| 10,316,658 | B2 * | 6/2019 | Ayyad | E21B 49/10 |
| 10,883,365 | B2 * | 1/2021 | Naveena-Chandran | E21B 49/10 |
| 2008/0078581 | A1 * | 4/2008 | Goodwin | E21B 49/082 175/50 |
| 2014/0311234 | A1 | 10/2014 | Sherrill | |
| 2014/0353479 | A1 | 12/2014 | Edwards et al. | |

* cited by examiner

APPARATUS AND METHODS FOR HIGH QUALITY ANALYSIS OF RESERVOIR FLUIDS

CROSS REFERENCE TO RELATED APPLICATIONS

This application claims the benefit of U.S. Provisional Patent Application Ser. No. 62/492,266 filed 20 Jan. 2018 and Patent Cooperation Treaty Application Serial No. PCT/US2019/13727 filed 16 Jan. 2019. The disclosure of the applications above are incorporated herein by reference in their entirety.

BACKGROUND OF THE INVENTION

Field of the Invention

Embodiments of the invention generally relate to tools and techniques for performing downhole formation testing and, more particularly, to a novel testing and positioning system and method.

Description of the Related Art

In oil and gas exploration, a primary goal of a wireline testing tool is to obtain fluid samples from earth formations, representative of the reservoir. These samples are examined in special laboratories for purposes such as to discover their physical composition.

FIG. 1 illustrates a typical prior art embodiment of a formation testing tool 10 wherein the tool is shown deployed in wellbore 14 and includes various modules as will be described in more detail herein below. A multi-conductor cable 12 carries electrical power and data to and from the surface. Formation testing tool 10 incudes a pair of back-up shoes, or jacks, 15, 16 that are urged against the borehole wall 17 by pistons to stabilize the formation tester within the wellbore 14. The formation testing tool 10 includes a probe assembly 18 having a pair of hydraulic pistons to urge the probe pad, or donut packer, 19 against borehole wall 17 with sufficient force to releasably fix the formation tester in place. The probe pad 19, sometimes referred to as a donut (or doughnut) packer, further seals the formation 20 from the wellbore 14 in the area of contact. A snorkel 21 of probe assembly 28 can come into contact with, and may penetrate, the borehole wall 17 and any mud cake that may exist adjacent thereto and can enter the formation area 13. As will be described in greater detail herein below, the probe assembly 28 is in hydraulic communication with a pump mounted within the formation tester housing 26. The probe assembly may also include a guard ring (not shown) and which may comprise a loop that encircles the ring and is hydraulically coupled to a pump mounted within the formation tester housing 26. An exemplary embodiment of a focused guard probe is disclosed in U.S. Pat. No. 6,301,959 (959) to Hrametz, the disclosure of which is included herein in its entirety. It should be appreciated that the probe pad 19 and the shoes 15, 16 are three points that determine a plane so that the formation tool does not rotate or wobble in the preselected downhole position. Within the prior art, shoes 15, 16 are placed in close proximity to probe assembly 18 and are positioned equidistant from the centerline 22 of snorkel 21 and are typically positioned 4" to 10" from the center of the probe. An exemplary embodiment of such a prior art tool is set forth in U.S. Pat. No. 4,593,560 to Purfurst, wherein the push off pistons are preferably evenly spaced from the snorkel. Shoes 15, 16 are typically hydraulically powered by a single pump and exert the same amount of force against borehole wall 17, and positioned equidistant from centerline 22 of snorkel 21, such that probe pad 19 is positioned flush against the borehole wall to establish and maintain the aforementioned seal against borehole wall 17. In addition, with the shoes 15, 16 placed in close proximity to probe assembly 18 the bending stress on formation testing tool 10 is kept at a minimum.

Still referring to FIG. 1, formation testing tool 10 is comprised of various modules that can include a hydraulic power module 23, probe module 24, testing module 25, and sample chamber module 27. Hydraulic power module 23 typically includes an electric motor and pump to provide hydraulic power for actuating the probe assembly 18 and the shoes 15, 16. Probe module 24, in addition to probe assembly 18 and shoes 15, 16, can include pressure gauges, temperature gauges, a pre-test chamber, a resistivity sensor and other sensors. Testing module 25 can include fluid analyzers, such as optical fluid spectrometers, density sensors, viscosity sensors and the like.

It is known that when reservoir fluid enters the snorkel 21 and sampling conduit of the formation testing tool 10, the sample can be altered or damaged by the tool itself. For example, the sour gas (such as hydrogen sulfide ($H_2S$)) content of the reservoir fluid is immensely important to assessing a reservoir since it determines, among other things, the price of the crude and whether very large capital expenditures will be needed in production plant to accommodate and remove this poisonous and corroding gas. However, many commonly used materials in downhole tools readily absorb this gas. Examples include elastomers, lubricating and hydraulic oils, and certain metals. During sampling, it is desirable to minimize exposure to these materials both in surface contact area and in residence time.

Another consideration in the use of formation tools is the consequence of prolonged residence time within the tool between the time the reservoir fluid enters the snorkel 21 and sampling conduit and the time when the fluid is analyzed. If the residence time is too long, the components of the sample can separate or become otherwise compromised. The residence time can be prolonged by the nature of the tool design and/or by the reservoir characteristics. In the latter case, a low permeability formation may only permit a low sampling flow rate, as a higher rate would drop the sampling pressure to below the fluid bubble point. A low sampling flow rate necessarily results in a longer residence time. It is desirable therefore to minimize the physical volume of the conduit and other upstream components to reduce the separation of the sample components within the conduit. Moreover the component fractions may differ from the original fluid due to different transit times and traps within the tool.

It is therefore an object of the present disclosure to have a method and apparatus for testing formation fluid that will minimize residence time, minimize separation of the sample within the conduit, position testing devices closer to the probe, and that will maintain the seal between the donut (or doughnut) packer and the borehole wall.

SUMMARY OF THE INVENTION

In some aspects of the present disclosure, a probe module for a formation dynamic testing (FDT) tool includes a component compartment wherein the component compartment is positioned in close proximity to the probe. In other aspects of the present invention, the probe module can be included in a wireline deployed formation tester or a logging while drilling (LWD) or measurement while drilling (MWD) tool having the ability to dynamically flow fluids from the reservoir while producing information about the reservoir fluids and their production.

In other aspects of the present disclosure a tool for downhole formation testing includes a probe capable of laterally extending from one side of the tool and has a snorkel to contact a borehole wall and includes a packer positioned about the snorkel to seal against the borehole wall. The tool also includes a first shoe capable of laterally extending from the tool and positioned a first predetermined axial distance from the probe and a second shoe capable of laterally extending from the tool and positioned a second predetermined axial distance from the probe where the first predetermined axial distance is substantially greater than the second predetermined axial distance and the second predetermined axial distance is proximate the probe and has a first component compartment positioned within the tool proximate the probe between the probe and the first shoe.

In other embodiments, the tool includes a second component compartment positioned proximate the second shoe and wherein the second shoe is positioned between the probe and the second component compartment. Devices such as a pressure sensor, an optical analyzer, a density analyzer, an NMR, a fluid analyzer, an $H_2S$ sensor, a $CO_2$ sensor, an acoustic sensor, a resistivity sensor, or a nuclear device can be disposed within the first and second component compartments capable of providing parameters related to a formation. In certain embodiments the devices include a pulsed neutron generator and a sodium iodide scintillation crystal.

In still other aspects of the present disclosure a method of positioning a tool in a borehole for downhole formation testing includes extending a probe having a packer from a first side of the tool to contact a borehole wall and extending a first shoe from the tool against the borehole wall wherein the first shoe is positioned a first predetermined axial distance from the probe and extending a second shoe from the tool against the borehole wall wherein the second shoe is positioned a second predetermined axial distance from the probe and wherein the first predetermined axial distance is substantially greater than the second predetermined axial distance and sealing the packer against the borehole wall.

In other aspects of the disclosure the method includes producing a first jack moment about the probe with a first force at the first shoe and producing a second jack moment about the probe with a second force at the second shoe where the first jack moment and the second jack moment are controlled to be approximately equal to one another.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 2:
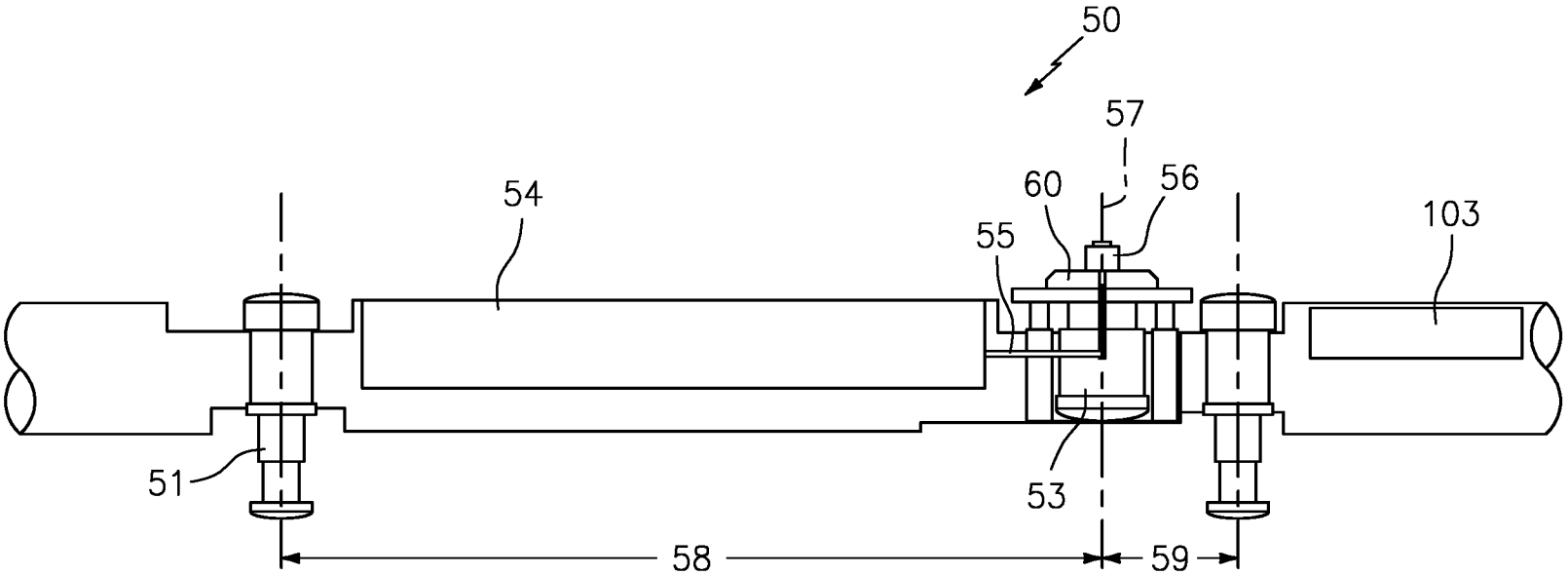
FIG. 2 illustrates a probe module in accordance with certain aspects of the present disclosure.

The present disclosure is drawn to a probe module 50 as shown in FIG. 2 for a formation dynamic testing (FDT) tool which includes a second component compartment 54 positioned in close proximity to a probe 56. The present invention may comprise a wireline deployed formation tester or a logging while drilling (LWD) or measurement while drilling (MWD) tool having the ability to dynamically flow fluids from the reservoir while producing information about the reservoir fluids and their production.

Figure 1:
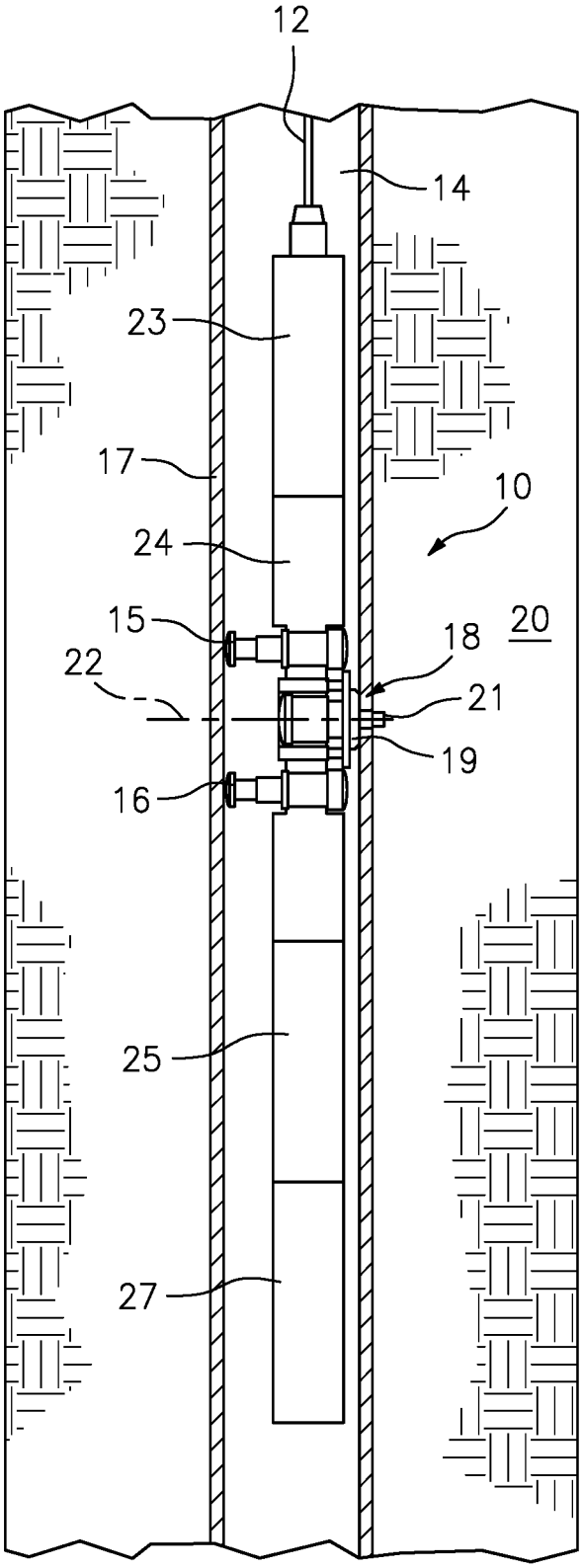
FIG. 1 (PRIOR ART)
FIG. 1 illustrates a wireline deployed formation tester of the prior art, including a probe module.

As described herein before and with reference to FIG. 1, it is well known to draw reservoir fluid through a snorkel 21 for the purpose of performing tests and analyses on the fluid using various sensors and testers located in various modules capable of providing parameters related to the reservoir. Such sensors and testers may include, pressure sensors, optical analyzers, density analyzers, nuclear magnetic resonance (NMR), fluid analyzers, $H_2S$ sensors, carbon dioxide ($CO_2$) sensors, acoustic sensors, resistivity sensors, nuclear devices, and such nuclear devices known as time lapsed sigma Neutron as disclosed in co-pending application WO2017015340, the disclosure of which is incorporated herein in its entirety, and other such known testing modules. Heretofore, it has not been possible to place such sensors and testers in probe module 50 in close proximity to the snorkel. As discussed herein above, it is desirable to perform such tests and analyses as close to the probe assembly 53 as possible.

Referring still to FIG. 2, there is shown a probe module 50 of the present disclosure that includes an upper shoe 51, a lower shoe 52, a probe assembly 53 and second component compartment 54. The terms "upper" and "lower" as used herein are for relative reference and refer to the position the probe module might be in while disposed within a wellbore. However, probe module 50 could be positioned within a wellbore in any orientation without departing from the scope of the present invention. Second component compartment 54 can include any number of components, sensors or modules for testing or analyzing reservoir fluids as discussed immediately herein above. In addition, second component compartment 54 can include sampling conduit 55 which is capable of providing hydraulic communication with the reservoir through probe 56 for moving fluids in and out of the component compartment and any of the testing or analyzing equipment positioned therein as appropriate. Unlike similar tools in the prior art, upper shoe 51 and lower shoe 52 are asymmetrically spaced along the axial length of probe module 50 with respect to probe centerline 57 of probe 56 wherein the upper shoe is positioned a predetermined axial distance 58 away from probe centerline 57 and the lower shoe is positioned a different predetermined axial distance 59 away from probe centerline 57. In the embodiment shown predetermined axial distance 58 is approximately 24" from probe centerline 57 and predetermined axial distance 59 is approximately 4" away from probe centerline 57. In other embodiments predetermined axial distance 58 can be 20"-30" from probe centerline 57 and predetermined axial distance 59 can be 3"-10" away from probe centerline 57. In accordance with the present disclosure, predetermined axial positions 58, 59 can be best determined by the desired size of second component compartment 54 which is dependent upon the number, type and size of components, sensors or modules for testing or analyzing reservoir fluids to be positioned within the compartment and predetermined axial distance 58 can be 2-6 times greater than predetermined axial distance 59. Also shown in FIG. 2 is a second component compartment 103 positioned downhole from lower shoe 52. Component compartment 103, as part of the present disclosure, enables other heretofore undiscovered functionality as will be described herein below.

Figure 3:
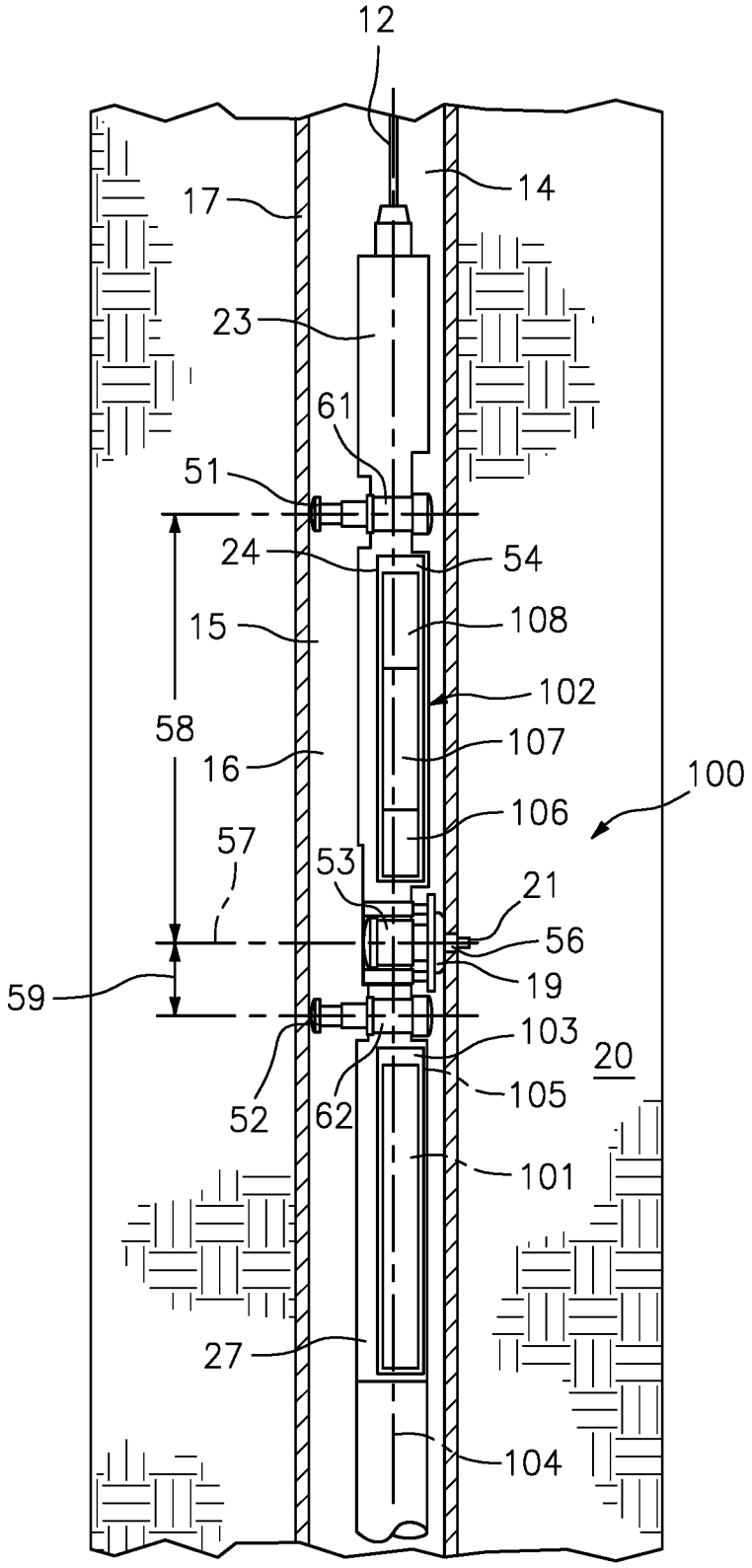
FIG. 3 is a schematic representation of an exemplary wireline deployed formation tester having a probe module in accordance with certain aspects of the present disclosure.

In operation, it is an aspect of the present disclosure that probe pad, or donut packer, 60 can be pressed against the borehole wall 17 (FIG. 3) and shoes 51, 52 are extended such that the pad rests sensibly parallel against the borehole wall and seals there against as discussed herein above. It will be appreciated by those skilled in the art, in the embodiment shown, that if the force exerted by shoe 51 against the borehole wall is the same as the force exerted by shoe 52, as in the prior art, it would result in an imbalanced moment about probe pad 60 and likely result in an inability to provide a seal there against. In the embodiment of the present invention shown, and as will more fully described herein below, the force exerted by shoe 51 is therefore less than the force exerted by shoe 52. This can be accomplished by any means suitable such as reducing the size and power of piston 61 associated with shoe 51 relative to the size and power of piston 62 on shoe 52, by valving or any other suitable means without departing from the scope of the present invention. In addition to the risk of an inability to seal, an imbalanced moment about probe pad 60 would result in the tool tilting within the wellbore 14 and increasing the possibility of sticking against the borehole wall 17 (FIG. 3). In embodiments of the present disclosure that include straddle packers (not shown), or other tool components, an imbalanced moment about probe pad 60 could also adversely affect the performance of such other components.

Examples of Tools for High Quality Analysis of Reservoir Fluids

Referring now to FIG. 3, there is shown an embodiment of probe module 100 of the present disclosure that includes, by way of specific example only, neutron generator source 101 and detector 102. Detector 102 is mounted within second component compartment 54 between probe assembly 53 and upper shoe 51 and electronic neutron generator source 101 is mounted within probe module 100 and outside (downhole) of shoe 52. It should be appreciated that such an embodiment enables neutron generator source 101 and detector 102 to obtain neutron measurements versus time from pulsed neutron capture and inelastic scattering decay curves as disclosed in the co-pending application WO2017015340. The neutron generator source 101 emits neutrons into formation 20 and the position of detector 102, relative to the source, provides for the thermal neutron capture data and allows for computer modeling and statistical analyses to obtain sigma values relating to one or more reservoir properties. Such an embodiment allows thermal neutron data capture while fluids are flowing in and out of formation 20 as will be discussed more fully herein after.

The embodiment shown in FIG. 3 further includes a formation analysis module comprised of computer hardware mounted at the surface or in the tool (not shown), neutron generator source 101 to emit neutron energy and detector 102 to capture neutron energy responses from the formation. Neutron energy responses include gamma rays emitted as a result of neutron capture within the formation as well as neutron capture within detector 102 causing ions to be created. Neutron generator source 101 and detector 102 are shown mounted in component compartment 103 and second component compartment 54 respectively such that the they are located close to the borehole wall 17 and offset from tool centerline 104. Neutron generator source 101 may be a pulsed neutron generator that includes a linear accelerator to produce neutrons by fusing deuterium atoms (DD) which results in the formation of a He-3 ion and a neutron with a kinetic energy of approximately 2.5 MeV. Neutron generator source 101 may also comprise a linear accelerator to produce neutrons by fusing a deuterium and a tritium atom (DT) which results in the formation of a He-4 ion and a neutron with a kinetic energy of approximately 14.1 MeV. Such neutron generator sources are known in the industry and are available, complete or as components, from commercial sources such as Sodern SODILOG (sodern.com) and American High Voltage NT-100 kV (ahv.com). In addition, neutron generator source 101 may advantageously comprise a source that emits a burst of neutrons that penetrate into formation 20 and specifically into and around the area of snorkel 21. Detector 102 is capable of detecting radiation at least associated with thermal neutron capture events. Such proximity to the borehole wall may also allow a lower power source to be used. An issue with utilizing a low power source is that the neutron generator source 101 must be located in close proximity to the detector 102. This issue is addressed in the embodiment shown wherein upper shoe 51 and lower shoe 52 are asymmetrically spaced along the axial length of probe module 50 with respect to probe centerline 57 of probe 56 wherein the upper shoe is positioned a predetermined axial distance 58 away from probe centerline 57 and the lower shoe is positioned a different predetermined axial distance 59 away from probe centerline 57. In accordance with the present disclosure, predetermined axial positions 58, 59 are determined by the physical size, power and sensitivity of neutron generator source 101 and detector 102 as will be discussed more fully herein below.

In the embodiment shown in FIG. 3, source 101 can be a pulsed neutron generator and the emitting end 105 is positioned uphole within compartment 103. Detector 102 can include a sodium iodide (NaI) scintillation crystal 106, a photomultiplier 107, and an electronics bay 108. As will be appreciated by those skilled in the art, the distance between the emitting end 105 of neutron generator source 101 and the midpoint of the axial length of crystal 106 of detector 102, among other factors, is critical to the ability of probe module 100 to obtain neutron measurements versus time from pulsed neutron capture and inelastic scattering decay curves. In the embodiment shown this distance can be between 17" and 21" to provide adequate performance. It will be appreciated that prior art probe modules having shoes positioned symmetrically about the probe fail to provide adequate proportions and access to position the source and detector as set out in the present invention.

Still referring to FIG. 3, in operation, probe pad 19 can be extend outward from probe module 100 toward borehole wall 17 and shoes 51, 52 are extended such that the probe pad rests parallel against the borehole wall and seals there against as discussed herein above. Once probe pad 19 is sealed against borehole wall 17 the clean-up and testing processes can begin as described herein above. In the embodiment shown, the force exerted against borehole wall 17 by shoe 51 ($F_{51}$) and that exerted by shoe 52 ($F_{52}$) are different such that the moments produced by each shoe about probe centerline 57, referred to as the "jack moment" are approximately equivalent in accordance with the following relationship:

$$\text{Jack Moment}=F_{51}*D_{58}F_{52}*D_{59} \quad \text{Equation 1}$$

In Equation 1, ($D_{58}$) is the predetermined axial distance 58 of shoe 51 from probe centerline 57 and ($D_{59}$) is the predetermined axial distance 59 of shoe 52 from the probe centerline. The forces $F_{51}$ and $F_{52}$ can be provided by any means suitable such as the size and power of pistons 61, 62 or by valving, separate pumps or any other suitable means without departing from the scope of the present invention.

While the foregoing is directed to only certain embodiments of the present invention certain observations of the breadth of the present invention should be made. Wireline, as referred to herein, may be electric wireline including telemetry and power. Wireline may also include wired slickline and wired coil tubing. Embodiments of the present invention include pumped-down-the-drill-pipe formation testing where the tools described herein exit through the drill bit. Otherwise heretofore conventional LWD that include the present invention allow for formation testing and sampling where the drill pipe may be wired for power and telemetry or some other telemetry such as mud pulse or electromagnetic through the earth. Embodiments of the present invention further include probe mounted sampling tools as well as straddle packer types and their use in open hole and cased hole wells. Further, commands and data can be stored using battery power, and power can come from a turbine during circulation. Other and further embodiments of the invention may be devised without departing from the basic scope thereof, and the scope thereof is determined by the claims that follow.

What is claimed is:

1. A tool for downhole formation testing comprising:

a probe capable of laterally extending from a first side of the tool and having a snorkel to contact a borehole wall and a packer positioned about the snorkel to seal against the borehole wall;

a first shoe capable of laterally extending from the tool positioned on a second side of the tool opposite the first side and positioned a first predetermined axial distance from the probe;

a second shoe capable of laterally extending from the tool positioned on the second side of the tool and positioned a second predetermined axial distance from the probe;

wherein the first predetermined axial distance is substantially greater than the second predetermined axial distance;

a first component compartment positioned within the tool proximate the probe between the probe and the first shoe, and a second component compartment positioned proximate the second shoe and wherein the second shoe is positioned between the probe and the second component compartment.

2. The tool of claim 1 further comprising at least one device disposed within the first component compartment capable of providing at least one parameter related to a formation.

3. The tool of claim 2 wherein the at least one device is any one of a pressure sensor, an optical analyzer, a density analyzer, an NMR, a fluid analyzer, an $H_2S$ sensor, a $CO_2$ sensor, an acoustic sensor, a resistivity sensor, or a nuclear device.

4. The tool of claim 2 further comprising a sampling conduit capable of providing hydraulic communication between the probe and the at least one device.

5. The tool of claim 1 further comprising a neutron generator disposed in the second component compartment and a detector disposed in the first component compartment.

6. The tool of claim 5 wherein the neutron generator is comprised of a pulsed neutron generator and the detector is comprised of a sodium iodide scintillation crystal.

7. The tool of claim 1 wherein the first predetermined axial distance is between 20 inches and 30 inches from the probe and the second predetermined axial distance is between 3 inches and 10 inches from the probe.

8. The tool of claim 1 wherein the first shoe is capable of exerting a first force against the borehole wall and the second shoe is capable of exerting a second force against the borehole wall.

9. The tool of claim 8 wherein the first force produces a first jack moment about the probe and the second force produces a second jack moment about the probe and wherein the first jack moment and the second jack moment are approximately equal and are governed by the following relationship:

$$F_1*D_1 \approx F_2*D_2$$

wherein $F_1$ is the first force, $D_1$ is the first predetermined axial distance, $F_2$ is the second force, and $D_2$ is the second predetermined axial distance.

10. The tool of claim 9 wherein $D_1$ is between 20 inches and 30 inches and wherein $D_2$ is between 3 inches and 10 inches.

11. The tool of claim 9 wherein $D_1$ is approximately 24 inches and wherein $D_2$ is approximately 4 inches.

12. A method of positioning a tool in a borehole for downhole formation testing comprising:

extending a probe having a packer from a first side of the tool to contact a borehole wall;

extending a first shoe from the tool against the borehole wall wherein the first shoe is positioned on a second side of the tool opposite the first side and wherein the first shoe is positioned a first predetermined axial distance from the probe;

extending a second shoe from the tool against the borehole wall wherein the second shoe is positioned on the second side of the tool opposite the first side and wherein the second shoe is positioned a second predetermined axial distance from the probe and wherein the first predetermined axial distance is substantially greater than the second predetermined axial distance;

sealing the packer against the borehole wall;

providing a first component compartment positioned within the tool proximate the probe between the probe and the first shoe; and providing a second component compartment proximate the second shoe wherein the second shoe is positioned between the probe and the second component compartment.

13. The method of claim 12 further comprising disposing at least one first device within the first component compartment capable of providing at least one parameter related to the downhole formation.

14. The method of claim 13 further comprising disposing at least one second device within the second component compartment capable of providing at least one parameter related to the downhole formation.

15. The method of claim 14 wherein the at least one first device and the at least one second device is any one of a pressure sensor, an optical analyzer, a density analyzer, an NMR, a fluid analyzer, an $H_2S$ sensor, a $CO_2$ sensor, an acoustic sensor, a resistivity sensor, or a nuclear device.

16. The method of claim 12 further comprising exerting a first force against the borehole wall with the first shoe and exerting a second force against the borehole wall with the second shoe.

17. The method of claim 16 producing a first jack moment about the probe with the first force and producing a second jack moment about the probe with the second force and wherein the first jack moment and the second jack moment are approximately equal and are governed by the following relationship:

$$F_1 * D_1 \approx F_2 * D_2$$

wherein $F_1$ is the first force, $D_1$ is the first predetermined axial distance, $F_2$ is the second force, and $D_2$ is the second predetermined axial distance.

* * * * *